United States Patent [19]

Ménard

[11] 4,386,798

[45] Jun. 7, 1983

[54] LOCKING AND LATCH CONTROL DEVICE FOR VEHICLE DOORS

[75] Inventor: Michel Ménard, Beynes, France

[73] Assignee: Regie Nationale des Usines Renault, Boulogne-Billancourt, France

[21] Appl. No.: 199,058

[22] Filed: Oct. 20, 1980

[30] Foreign Application Priority Data

Oct. 19, 1979 [FR] France ..... 79 26018

[51] Int. Cl.[3] ..... E05C 3/16

[52] U.S. Cl. ..... 292/336.3; 292/DIG. 27; 292/216

[58] Field of Search ..... 292/216, 280, DIG. 27, 292/DIG. 26, 336.3

[56] References Cited

U.S. PATENT DOCUMENTS

| | | | |
|---|---|---|---|
| 3,365,226 | 1/1968 | Shay | 292/DIG. 27 |
| 3,591,220 | 7/1971 | Sandor | 292/216 |
| 3,695,663 | 10/1972 | Cockburn | 292/DIG. 27 |
| 4,166,646 | 9/1979 | Ménard et al. | 292/336.3 |

*Primary Examiner*—Richard E. Moore

*Attorney, Agent, or Firm*—Oblon, Fisher, Spivak, McClelland & Maier

[57] ABSTRACT

A lock plate is disclosed. It consists of a locking lever 4 with two stable positions on which an intermediary opening lever 14 is mounted so as to pivot. The latter lever avoids being moved through disengagement by means of an outside control lever 17 when the locking lever 4 is in its locked position. In the unlocked position, the hinge axes 16, 13 of the outside control lever and the intermediary lever are superimposed.

4 Claims, 7 Drawing Figures

LOCKING AND LATCH CONTROL DEVICE FOR VEHICLE DOORS

BACKGROUND OF THE INVENTION

1. Field of the Invention

This invention concerns a locking and latch control device for the door of a motor vehicle and, in particular a lock plate, especially for a side door, consisting of a lever which closes the lock when it is activated either from an inside control in the vehicle or from an outside cylinder lock operated by a key.

2. Description of the Prior Art

The U.S. Pat. No. 4,166,646 of the present inventor describes one form of a locking and latch control device in which, depending on the position of the main lever, it is possible to close the lock by blocking the movement of the outside door-opening control lever, which is accessible to the user directly within the door itself. But this system has the disadvantage of leaving the possibility of applying pressure on the outside control when the lock is closed, which can cause the blocking elements to be deformed to such a point that the lock may be opened by thieves.

Conversely, closing the lock by means of disengagement (in a known manner) of the outside control eliminates this drawback. Moreover, the operation of the device, made very easy by such disengagement, alerts the authorized user to the closed status of the lock. He therefore makes no effort to apply force to the opening handle.

French Patent Application No. 78/34 739 and its supplement No. 79/15 498, also of the present inventor, describe lock-closing devices using disengagement of the opening control, but they involve applications designed especially for the locking of trunk lids by means of a turning knob which incorporates a cylinder.

SUMMARY OF THE INVENTION

The object of this invention is to make use of a plate with a simplified design such as that described in U.S. Pat. No. 4,166,646 and to modify it so as to combine it with a disengagement locking arrangement.

As a result, certain basic elements are used again, such as the plate of the lock with a principal lever, known as a locking lever, pivoting around a first hinge axis, and an outside opening control lever pivoting around a second axis, separate from and parallel to the first, there being the possibility of moving the locking lever into one of its two fixed positions either from inside the vehicle by means of an inside control lever, or from the outside by means of the finger of a cylinder lock.

The locking lever has a general U-shape and its respective ends bear, on the one hand, the first axis mentioned above and, on the other hand, a third axis to make a joint with an intermediary opening lever made movable with the locking lever and pivoting with the latter around the first axis in such a way that, when the locking lever is in its first stable position, known as the unlocked position, the third axis is superimposed over the second so as to make it possible to rotate the intermediary lever by means of the outside control lever in order to open the lock, and, when the locking lever is in its second stable position, known as the locked position, after having pivoted around the first axis, the intermediary lever is not moved by the outside control lever as a result of a known disengagement process.

According to another characteristic of the invention, the intermediary lever has a sector shape, one rectilinear side of which lends itself to being pulled by the outside control lever which has a stop for that purpose, the other rectilinear side of which is able in turn to pull a releasing finger for the bolt of the lock, said stop, the intermediary lever and the finger functioning within the circular hole formed between the branches of the clocking lever when in the unlocked position, with the intermediary lever pushed against the stop by means of a spring fixed between the intermediary lever and the locking lever.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
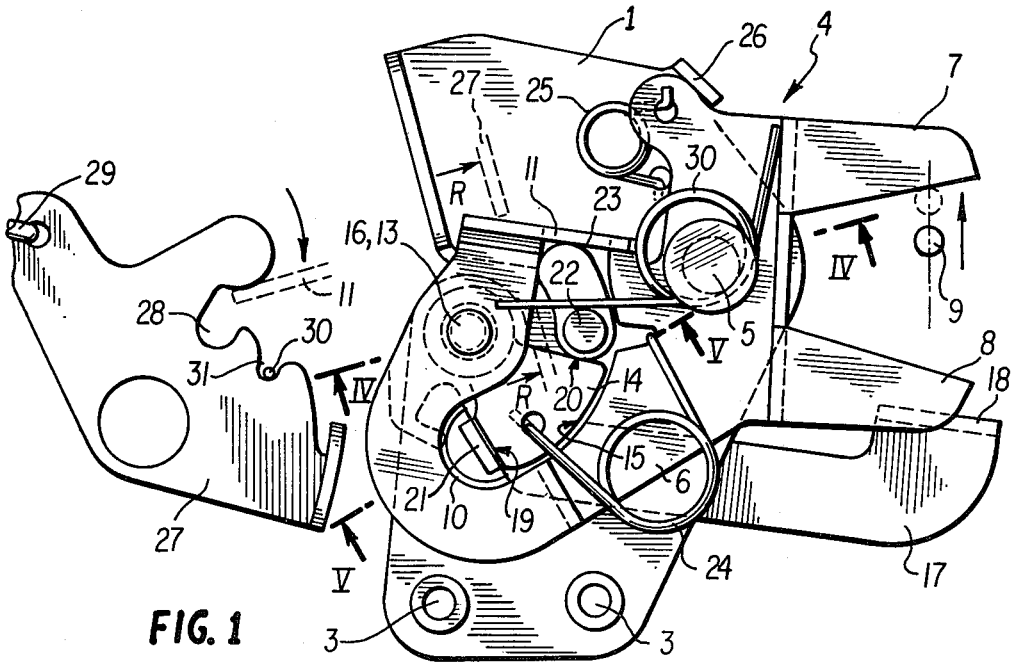
FIG. 1 represents the preferred embodiment in the unlocked, or engaged position.

FIG. 1 represents, in plane section, the entire device of the preferred embodiment mounted on a support plate 1, itself attached to the sheet metal 2 in the body of a side door of a vehicle by means of screws passing through drilled holes such as those represented at 3.

The locking lever 4, mounted so as to pivot around a first fixed axis 5 which is part of the plate, has in general the shape of a disfigured U, while the hinge axis 5 is located approximately at the end of one of the branches 6 of the U, the branch 6 being extended transversely by a rigid jaw consisting in an upper protrusion 7 and a lower protrusion 8 which may come in contact with a locking finger 9, itself moved vertically by the outside cylinder lock (not shown).

The space made between the branches of the U forms an arcuate hole 10, closed on the upper side by a return 11 turned in a right angle and made as the extension of the end of the second branch 12 of the locking lever 4. This latter branch has another axis, called the third axis 13, for the movement of an intermediary opening lever 14, relative to the locking lever 4, and pivoting with the latter around the first axis 5, relative to the plate 1. The first and third axes 5, 13 are represented in cross section in FIG. 4.

The intermediary lever 14 forms a small sector which can come into play in the hole 10 for the locking lever by partially covering it over, the curvilinear edge 15 of the sector matching with the arcuate shape of the hole 10.

When the locking lever 4 is in the position represented in FIG. 1, the axis 13 of the intermediary lever 14 is superimposed over another theoretical joint 16, stationary with respect to the plate (FIG. 4) and known as the second axis, provided for the rotation of the outside opening control lever 17. The end 18 of this lever is directly accessible to the user, inside the body of the door, by means of a hollow access space provided in the body work.

Still in the position shown in FIG. 1, the two rectilinear sides 19, 20 of the sector of the intermediary lever 14 respectively come into contact, on the one hand, with a stop 21 protruding perpendicularly from the outside control lever 17, and, on the other hand, a finger 22 for releasing the bolt of the lock, said finger being able to move around the theoretical axis 16 while crossing a curvilinear space 23 in the plate between the intermediary lever 14 and the inside surface of the square 11 in the locking lever. The intermediary lever is constantly pushed against the stop 21 by means of a spring 24 attached between said intermediate lever and the locking lever. Moreover, the locking lever 4 may be kept in one of its two stable positions, corresponding to FIGS. 1 and 3, respectively, by means of a two position spring 25 attached between said lever and the plate. For each of these positions, the movement of the locking lever is limited by an upper stop 26 on the plate.

Figure 3:
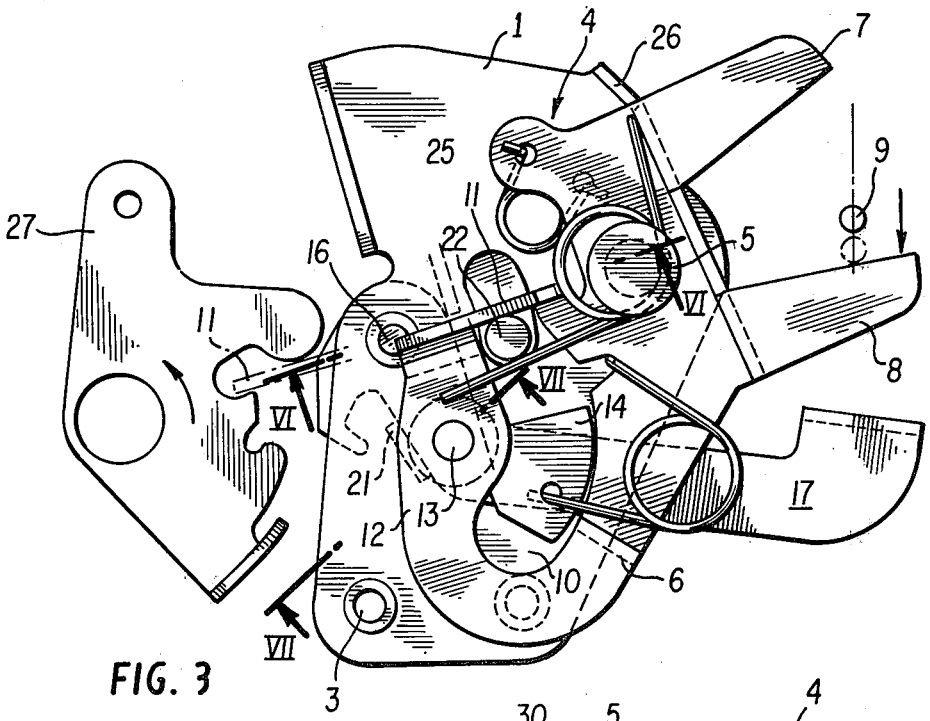
FIG. 3 represents the apparatus of FIG. 1 in the locked, or disengaged position.

In addition to activation of the locking lever 4 by the outside lock finger 9 referred to above, the locking lever may also be rocked at random in the position which suits the user by pivoting an inside control lever 27 which acts perpendicularly to the plane of the plate (dotted line), and which is represented, for greater clarity, by the supplementary view portions placed on the left side of FIGS. 1 and 3. The movement is transmitted through the upper square 11 of the locking lever penetrating into a cut-out 28 in the inside control lever 27, itself activated from inside the vehicle by a transferal of movement by a device such as a rod 29 attached to said lever. A return spring 30 wrapped around the axis 5 of the locking lever (FIG. 4) puts the inside control lever into the locked position of FIG. 3 by pressing against, on the one hand, the jaw 7 of the locking lever, and, on the other hand, against a second cutout 31 of the inside control lever.

Figure 4:
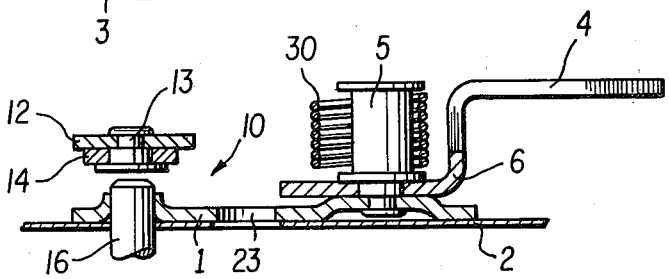
FIGS. 4 and 5 are cross-sections passing through lines IV and V of FIG. 1.

The device operates in the following manner:

In FIG. 1, the locking lever 4 is in its first stable position, called the unlocked or engaged position, in which the hinge axes 16, 13 of the outside control lever and the intermediate lever are lined up (FIG. 4).

Figure 5:
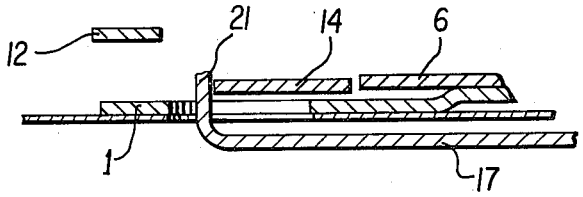

As the outside opening control lever 17 is in the resting position, its stop 21 is opposite the intermediary opening lever 14 (FIG. 5).

Figure 2:
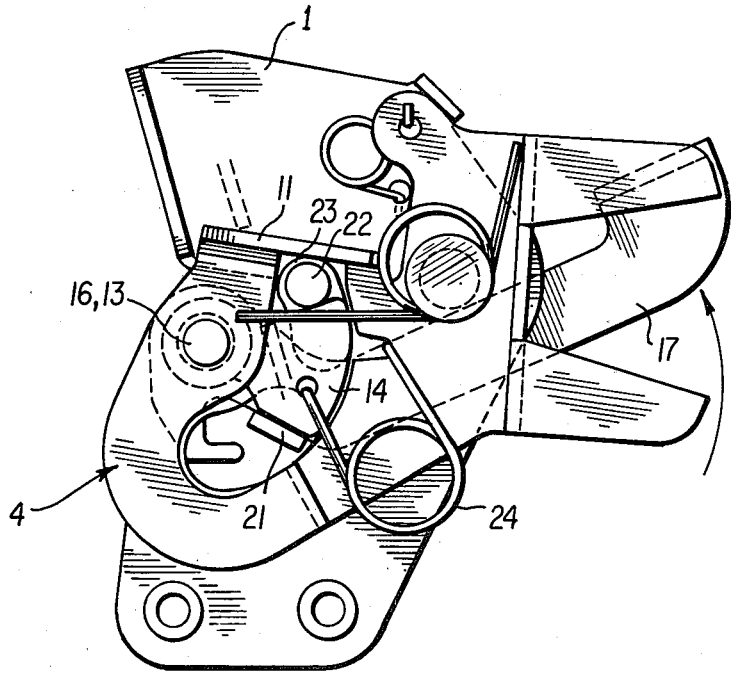
FIG. 2 is a view identical to FIG. 1, illustrating the opening of the lock.

The opening of the lock and hence of the door corresponds to the change from FIG. 1 to FIG. 2, in which the outside control lever 17 has been moved in an upward direction, pulling during its rotation, by means of its stop 21, the sector of the intermediary lever 14 and the finger 22 releasing the bolt of the lock. The movement is limited by the back of the curvilinear space 23 in the plate, with the finger brushing against the lower surface of the square 11 in the locking lever 4, which has remained stationary. The spring 24 returns the intermediary lever 14 and outside control lever 17 to their resting position shown in FIG. 1.

Closing the lock results from a pivoting of the locking lever 4 toward its second stable position shown in FIG. 3, a pivoting obtained either from the outside by moving the finger 9 of the cylinder lock against the upper protrusion 7 of the lever (FIG. 1), or from the inside by means of the pressure exerted downward by the inside control lever 27 against the square 11 of the locking lever.

Figure 7:
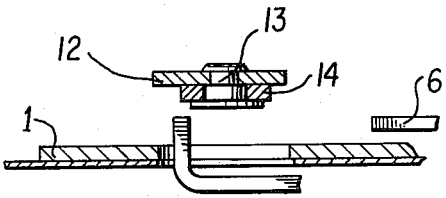

In the course of its rocking movement, the locking lever 4 pulls with it the sector of the intermediary lever 14 whose lower rectilinear side thus is free from the circular trajectory of the stop 21 of the outside control lever 17 (FIG. 7). Movement of the latter would therefore have no effect on the finger 22 of the bolt, which corresponds to the disengagement of said control.

Returning the locking lever 4 to the unlocked position in FIG. 1 may be brought about by reversing the previous actions with the finger 9 of the lock or the inside control lever 27, this in accordance with FIG. 3.

The device also allows for atuomatic unlocking of a door inadvertently locked prior to closing, simply by shutting the door against its stops.

Figure 6:
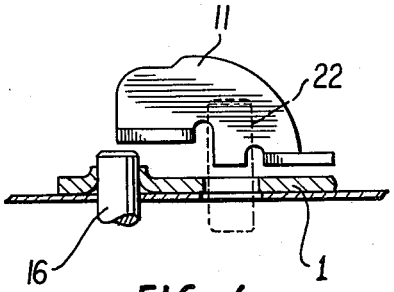
FIGS. 6 and 7 are cross-sections passing through lines VI and VII of FIG. 3.

With reference to the position shown in FIG. 3, such closing would result in the sudden upward movement of the release finger 22 of the bolt, pushing the finger against the square 11 in the locking lever (FIG. 6), which would cause the latter to rock into its unlocked position shown in FIG. 1, making the opening of the lock possible.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A lock control device for a motor vehicle door, comprising:

a lock plate fixed to said door;

a locking lever pivoted to said lock plate at a first axis, said locking lever having a shape approximately a U, a first leg of said U including a third axis;

a second axis on said lock plate, said second and third axes being parallel and being coaxial when said locking lever is pivoted into a first unlocked position about said first axis but being moved from said coaxial location when said locking lever is pivoted into a second locked position;

an outside opening control lever pivotable about said second axis; and an intermediary lever pivoted to said third axis and being movable therewith, said intermediary lever being engageable and rotatable by said outside opening control lever when said locking lever is in said first unlocked position and being moved by said third axis from said engageable and rotatable position when said locking lever is in said second locked position.

2. The device of claim 1 further comprising:

a releasing finger for the bolt of said lock, said releasing finger movable about said second axis and within an arcuate space formed between the legs of said U when said locking lever is in said first unlocked position; and spring means extending between said locking lever and said intermediate lever and biasing said intermediate lever against an engaging portion of said outside opening control lever;

wherein said intermediary lever is movable within said arcuate space and includes opposing sides within said arc, respectively engageable with said outside opening control lever and said releasing finger.

3. The device of claim 1, wherein said lock includes a releasing finger and wherein said first leg of said locking lever includes a return element, said return element engaging said releasing finger when said locking lever is in said second locking position, whereby said locking lever is automatically pivoted to said first unlocked position by said releasing finger when said door is shut.

4. The device of claim 3 further comprising:

an inside control lever pivoted on said lock plate and oriented perpendicular to said locking lever; and a coil spring wrapped around said first axis and extending between said locking lever and said inside control lever;

wherein said inside control lever is engageable with said return element, whereby said locking lever may be pivoted to said first or second position by said inside control lever.

* * * * *